US006435507B1

(12) United States Patent
Trucksess

(10) Patent No.: US 6,435,507 B1
(45) Date of Patent: Aug. 20, 2002

(54) TABLE-SLOTS GAME AND METHOD OF PLAY

(76) Inventor: Joseph R. Trucksess, 500 Lake St., HaddonHeights, NJ (US) 08035

( * ) Notice: Subject to any disclaimer, the term of this patent is extended or adjusted under 35 U.S.C. 154(b) by 37 days.

(21) Appl. No.: 09/588,334

(22) Filed: Jun. 6, 2000

Related U.S. Application Data

(63) Continuation-in-part of application No. 09/135,295, filed on Aug. 17, 1998, now Pat. No. 6,089,569.
(60) Provisional application No. 60/073,987, filed on Feb. 6, 1998.

(51) Int. Cl.[7] ..... A63F 1/00
(52) U.S. Cl. ..... 273/292; 273/274; 463/11
(58) Field of Search ..... 273/274, 292, 273/309, 308, 303; 463/11–13

(56) References Cited

U.S. PATENT DOCUMENTS

| | | | | |
|---|---|---|---|---|
| 3,667,757 | A | | 6/1972 | Holmberg |
| 3,913,919 | A | | 10/1975 | Carpenter |
| 4,234,186 | A | | 11/1980 | Forrest et al. |
| 4,294,451 | A | | 10/1981 | Wollner |
| D263,975 | S | | 4/1982 | Quiroga et al. |
| 5,257,789 | A | | 11/1993 | LeVasseur |
| 5,382,025 | A | * | 1/1995 | Sklansky |
| 5,489,101 | A | * | 2/1996 | Moody |
| 5,531,448 | A | * | 7/1996 | Moody |
| 5,630,586 | A | | 5/1997 | Lowden |
| 5,718,430 | A | * | 2/1998 | Aramapakul |
| 5,839,732 | A | | 11/1998 | Guidi |
| 5,921,550 | A | | 7/1999 | Awada |
| 6,170,827 | B1 | * | 1/2001 | Lombardo |

FOREIGN PATENT DOCUMENTS

| | | |
|---|---|---|
| GB | 964296 | 7/1964 |
| GB | 2124914 | 2/1984 |

OTHER PUBLICATIONS

Publication entitled "Casino Golf" dated Dec. 21, 1992 (admitted prior art).

Slot Machine Card Game, Robert Wollner, "Match A Jackpot Game", "Draw Jackpot Game", pp. 16–19.

* cited by examiner

*Primary Examiner*—Paul T. Sewell
*Assistant Examiner*—Vishu K. Mendiratta
(74) *Attorney, Agent, or Firm*—Volpe and Koenig, P.C.

(57) ABSTRACT

A method of playing a Table-Slots® card game is provided. The method includes providing a Table-Slots® table layout which provides slot machine play for a table game. The dealer deals cards from a shuffled deck into player card-receiving boxes and into a dealer card-receiving box. Each player may examine a portion of the player hand and may elect to use the dealer hand in combination with the player hand or the unexamined portion of the player hand in combination with the examined portion of the player hand. After the players make their election, all cards are revealed and winning combinations similar to those found on a slot machine are paid off by the dealer.

9 Claims, 3 Drawing Sheets

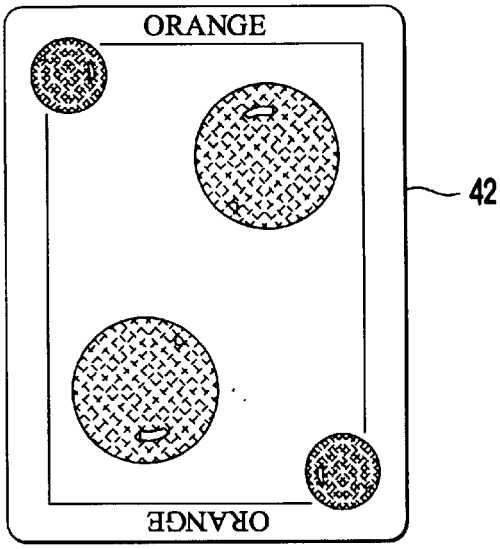
Fig. 2a
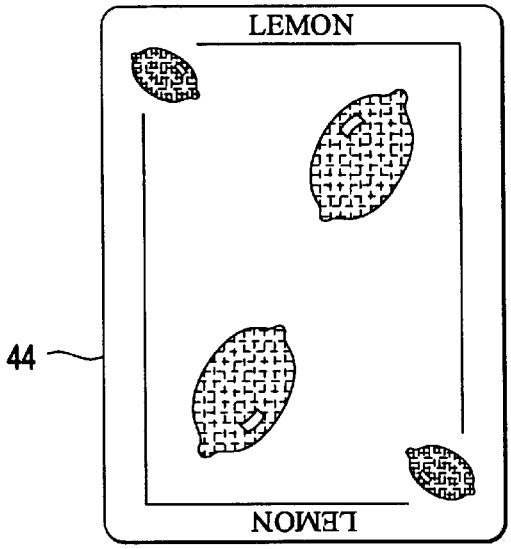
Fig. 2b
Fig. 2c
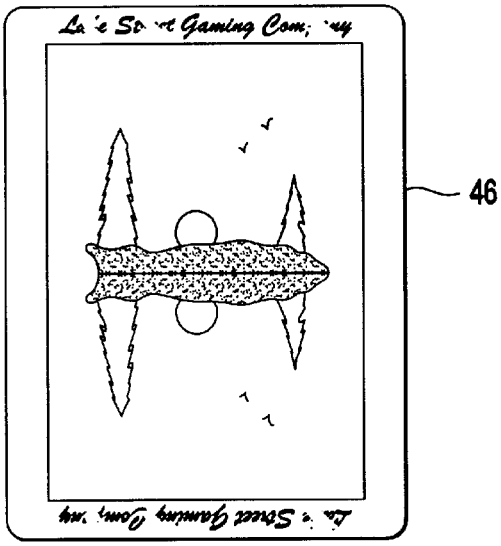
Fig. 2d
Fig. 2e
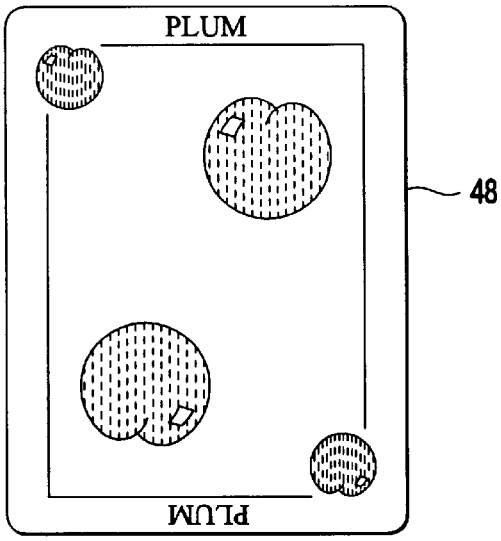
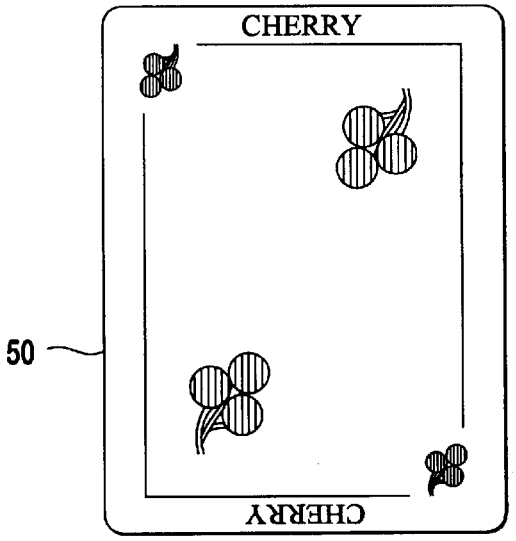

TABLE-SLOTS GAME AND METHOD OF PLAY

CROSS REFERENCE TO RELATED APPLICATIONS

This application is a continuation-in-part of U.S. application Ser. No. 09/135,295, filed Aug. 17, 1998, now U.S. Pat. No. 608,9569 which claims the benefit of U.S. Provisional Application No. 60/073,987, filed Feb. 6, 1998.

BACKGROUND

The present invention relates to casino table games, and more particularly, to a game which offers slot-machine type play in a table game environment. Slot machines attract a large number of players in casinos due to the ease of use and the simplicity of the wagers offered. Accordingly, slot machines account for a substantial share of the profit in gaming casinos.

However, one drawback of slot machine play is that it lacks appeal for certain types of players since there is no interaction with other players or a dealer. Additionally, the amount of wagers is limited on each play based on the number and denomination of coins which will be accepted by the slot machine. Slot machine play also lacks the comfort of many table games, such as blackjack, where a player is seated at the playing table. This is especially important for older players and senior citizens who do not want to stand at a slot machine or sit on a stool at a slot machine during extended periods of play.

It would be advantageous to casinos to provide a game which has the appeal and simplicity of slot machine play, yet which is offered in a table gaming environment in order to provide the benefit of interaction between players as well as between the player and the dealer. It would also be advantageous to provide a game which removes the limits imposed by a gaming machine on the amount which can be wagered on a given play. It would be similarly advantageous to casinos to provide a new table game for table game players which can have a relatively high rate of play while offering multiple wagering opportunities for the player for each play or deal of the game.

SUMMARY

Briefly stated, the present invention provides a method of playing a card game. The method includes:

(a) providing a deck of cards having at least five different symbols thereon and a gaming table with a plurality of player positions, the gaming table including five card receiving boxes for each player position and two card receiving boxes for a dealer position which are adapted to receive cards dealt from the deck, and each player position including three ante receiving areas;

(b) shuffling the deck of cards by the dealer;

(c) placing an ante in at least one ante receiving area by a player at each of the plurality of the player positions;

(d) the dealer dealing a card from the shuffled deck into each of the first two card receiving boxes for each player and dealing three additional cards to the player, and the dealer dealing a card into each of the two card receiving boxes for the dealer to create a dealer hand, at least one of the cards in the dealer hand being dealt face up;

(e) each player examining the three additional cards dealt to the player and placing the cards in the third, fourth and fifth card receiving boxes, and each player electing to play the unexamined first and second cards in the first and second player card receiving boxes or the dealer hand in combination with the examined player cards to form the player hand;

(f) determining if a three-card winning combination is present in the player hand, and if one of the three-card winning combinations is present, paying off the player who placed the ante in the ante receiving area for the three-card winning combination;

(g) determining if a four-card winning combination is present in the player hand, and if one of the four-card winning combinations is present, paying off the player who placed ante in the ante receiving area for the four-card winning combination; and (h) determining if a five-card winning combination is present in the player hand, and if one of the five-card winning combinations is present, paying off the player who placed the ante in the ante receiving area for the five-card winning combination, and if one of the five-card winning combinations is not present, the dealer collecting any ante remaining on the gaming table.

BRIEF DESCRIPTION OF THE DRAWINGS

The foregoing summary, as well as the following detailed description of preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings:

FIGS. 2*a*–2*e* are plan views of faces of playing cards used in connection with the first embodiment of the game in accordance with the present invention.

DETAILED DESCRIPTION OF THE PREFERRED EMBODIMENT

Figure 1:
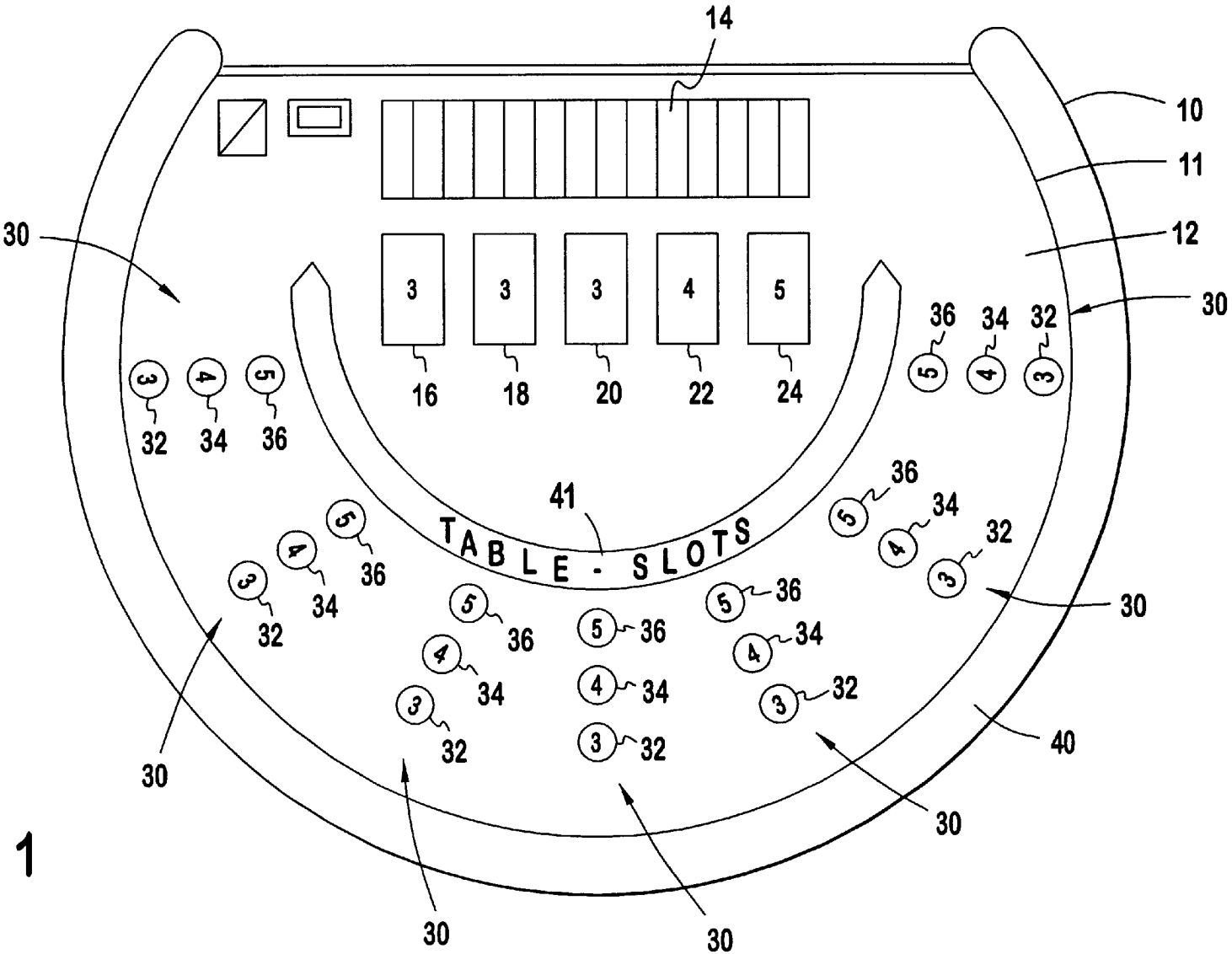
FIG. 1 is a plan view of a gaming table for playing a table-slots game in accordance with a first embodiment of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the gaming table for playing a Table-Slots® game in accordance with the present invention and designated parts thereof. The terminology includes the words above specifically mentioned, derivatives thereof and words of similar import.

As shown in FIG. 1, in the preferred embodiment of the present invention, a gaming table 10 having a semi-circular top 11 is provided. The top 11 has a covering 12 that is preferably made from felt, but may be made of other any suitable material, if desired. Preferably, the semi-circular top 11 of the table 10 is of a standard size for a casino table game, and the covering 12 is removable such that it may be placed onto an existing table top 10 used in connection with other casino table games such as blackjack.

The covering 12 includes provisions for a chip rack 14, and indicia used in connection with playing the game, which are described in more detail below, are printed on the covering 12. The chip rack 14 is located adjacent to the dealer area. Boxes 16, 18, 20, 22 and 24 are located on the covering 12 in front of the chip rack 14. The boxes 16, 18, 20, 22, 24 are preferably printed or silk-screened onto the covering 12. However, it will be recognized by those skilled in the art from the present disclosure that the boxes can be produced by any other suitable means, such as adhering another layer of material to the covering 12. Preferably, boxes 16, 18 and 20 also include the printed indicia "3". The fourth box 22 includes the printed indicia "4", and the fifth box 24 includes the printed indicia "5". The boxes 16, 18, 20, 22, 24 are preferably sized such that a playing card can be placed within the box. It will be recognized by those skilled in the art from the present disclosure that the particular form, shape and location of the boxes 16, 18, 20, 22 and 24 on the table may be varied, if desired.

Preferably, seven player positions 30 are located around the semicircular portion of the table 10. Each player position 30 includes a first wagering area in the form of a first circle 32 for a player's first ante. A second wagering area is provided in the form of a circle 34 for the player's second ante and a third wagering area in the form of a circle 36 is provided for the player's third ante. The first circle 32, second circle 34 and the third circle 36 are preferably marked with indicia "3", "4", and "5", respectively. The wagering areas 32, 34, 36 and the associated indicia "3", "4", and "5" are also preferably silk-screened or printed on the covering 12, but may be applied by other means, if desired. The shape can also be varied as desired. It will be recognized by those skilled in the art from the present disclosure that the number of boxes 16, 18, 20, 22 and 24 for receiving cards as well as the number of areas for the player's antes may be varied, if desired, depending upon the number of wagers which are to be made available for a given deal or play. It will be similarly recognized that the number of player locations 30 may be varied to suit particular sizes of gaming tables. The table 10 also preferably includes a cushioned rail 40 of the type generally known in the art. However, this can be eliminated, if desired. Printed indicia 41 identifying the game, the casino name or any other desired markings, may also be added to the covering 12 in a location that does not interfere with the game layout.

Referring now to FIGS. 2*a*–2*e,* in a first preferred embodiment, playing cards are provided having indicia which are typical of slot machines. Preferably, the playing cards are provided in a deck of fifty (50) cards, with ten (10) orange cards 42, as shown in FIGS. 2*a;* eight (8) lemon cards 44, as shown in FIG. 2*b;* five (5) logo cards 46, which may include any logo, such as the casino logo, as shown in FIG. 2*c;* twelve (12) plum cards 48, as shown in FIG. 2*d;* and fifteen (15) cherry cards 50, as shown in FIG. 2*e.* However, it will be recognized by those skilled in the art from the present disclosure that the number of cards 42, 44, 46, 48, 50 may be varied, as desired, in order to achieve the desired odds for casino wins and/or for a desired payout ratio. For example, in a second preferred embodiment, a deck of fifty-two (52) cards is provided, with fifteen (15) cherry cards 50, twelve (12) plum cards 48, ten (10) orange cards 42, ten (10) lemon cards 44 and five (5) casino logo cards 46. It will be similarly recognized that various other symbols may be used on the cards, such as "BAR", "7", etc.

In order to play the game, a deck of table-slots cards 42, 44, 46, 48, 50 is shuffled by hand by the dealer and then placed into an automatic shuffling machine. A second deck is also shuffled in a similar manner. Preferably, after the second deck of cards is shuffled, the dealer again shuffles the first deck in the shuffling machine. At this time, each player may place a minimum ante or optionally a larger wager in one or more of the wagering areas 32, 34 and 36. Five cards are then dispensed from the first deck into a holding tray. Preferably, these cards are placed in the discard rack and not used. The second five cards are then placed face down in order in boxes 16, 18, 20, 22 and 24 by the dealer.

The first three cards in boxes 16, 18 and 20 are then turned over beginning at the far left on the player's side. The dealer then pays each player that has placed the ante or a larger wager in the first wagering area 32 if a winning combination is present for the first three cards. In the first preferred embodiment using the deck of fifty (50) cards, the winning combinations for the first three cards and payoffs for a one dollar wager are as follows:

| Winning Combinations Three Card Game | Payoff in Dollars |
|---|---|
| C-*-* | 1 |
| C-C-C | 2 |
| P-*-* | 1 |
| P-P-P | 2 |
| O-*-* | 1 |
| O-O-O | 5 |
| L-L-L | 10 |
| CL-CL-CL | 100 |

*Represents any symbol

If a winning combination does not occur, then all antes and/or wagers on the table are collected, and the dealer begins a new hand with the second deck. If a winning combination occurs in the first three cards, once the winning bets are paid the dealer turns over the card in the fourth box 22. The four card winning combinations incorporate the first three cards turned over in the first three boxes 16, 18, 20 as well as the card in the fourth box 22. If this results in a winning four card combination, the dealer will again pay each player who has placed an ante or a larger wager in the second wagering area 34. In the first preferred embodiment using the deck of fifty (50) cards, preferably the players are paid off for winning bets in accordance with the following payout schedule for each one dollar wagered.

| Winning Combinations Four Card Game | Payoff in Dollars |
|---|---|
| C-C-C-C | 50 |
| P-P-P-P | 75 |
| O-O-O-O | 100 |
| L-L-L-L | 200 |
| CL-CL-CL-CL | 1,000 |

If a winning combination does not occur, then all antes and/or wagers remaining on the table are collected, and the dealer begins a new hand with the second deck. If a winning combination of four cards occurs, after the winning bets are paid for antes or larger wagers in the second wagering area 34 for each player, the dealer turns over the card in the fifth box 24. Winning combinations which can result in a payoff for the third wagering area 36 incorporate the combination of all five cards in boxes 16, 18, 20, 22 and 24. Again, if a winning combination occurs the dealer pays the winning players. In the first preferred embodiment using the deck of fifty (50) cards, the payout for winning combinations of five cards is as shown below for a one dollar wager.

| Winning Combinations Five Card Game | Payoff in Dollars |
|---|---|
| C-C-C-C-C | 200 |
| P-P-P-P-P | 400 |
| O-O-O-O-O | 500 |
| L-L-L-L-L | 1,000 |
| CL-CL-CL-CL-CL | 50,000 |

Once the hand is completed, the dealer places all the cards from the first deck, whether played or unplayed, in the discard rack. The dealer then riffles twice and places the cards back into the shuffling machine. During this time the dealer begins a second game using the second deck.

In the second preferred embodiment in which the deck of fifty-two (52) cards is utilized, the game is dealt in the same manner described above for the first embodiment. Preferably, the winning combinations for the first three cards and payoffs for a one dollar wager are as follows:

| Winning Combinations Three Card Game | Payoff in Dollars |
|---|---|
| C-*-* | Push |
| C-C-C | 1 |
| P-*-* | Push |
| P-P-P | 1 |
| O-*-* | 1 |
| O-O-O | 2 |
| L-L-L | 5 |
| CL-CL-CL | 25 |

*Represents any symbol

The winning combinations for the first four cards and payoffs for a one dollar wager are as follows:

| Winning Combinations Four Card Game | Payoff in Dollars |
|---|---|
| C-C-C-C | 50 |
| P-P-P-P | 100 |
| O-O-O-O | 200 |
| L-L-L-L | 400 |
| CL-CL-CL-CL | 500 |

The winning combinations for five cards and payoffs for a one dollar wager are as follows:

| Winning Combinations Five Card Game | Payoff in Dollars |
|---|---|
| C-C-C-C-C | 250 |
| P-P-P-P-P | 500 |
| O-O-O-O-O | 1,000 |
| L-L-L-L-L | 2,500 |
| CL-CL-CL-CL-CL | 50,000 |

Figure 3:
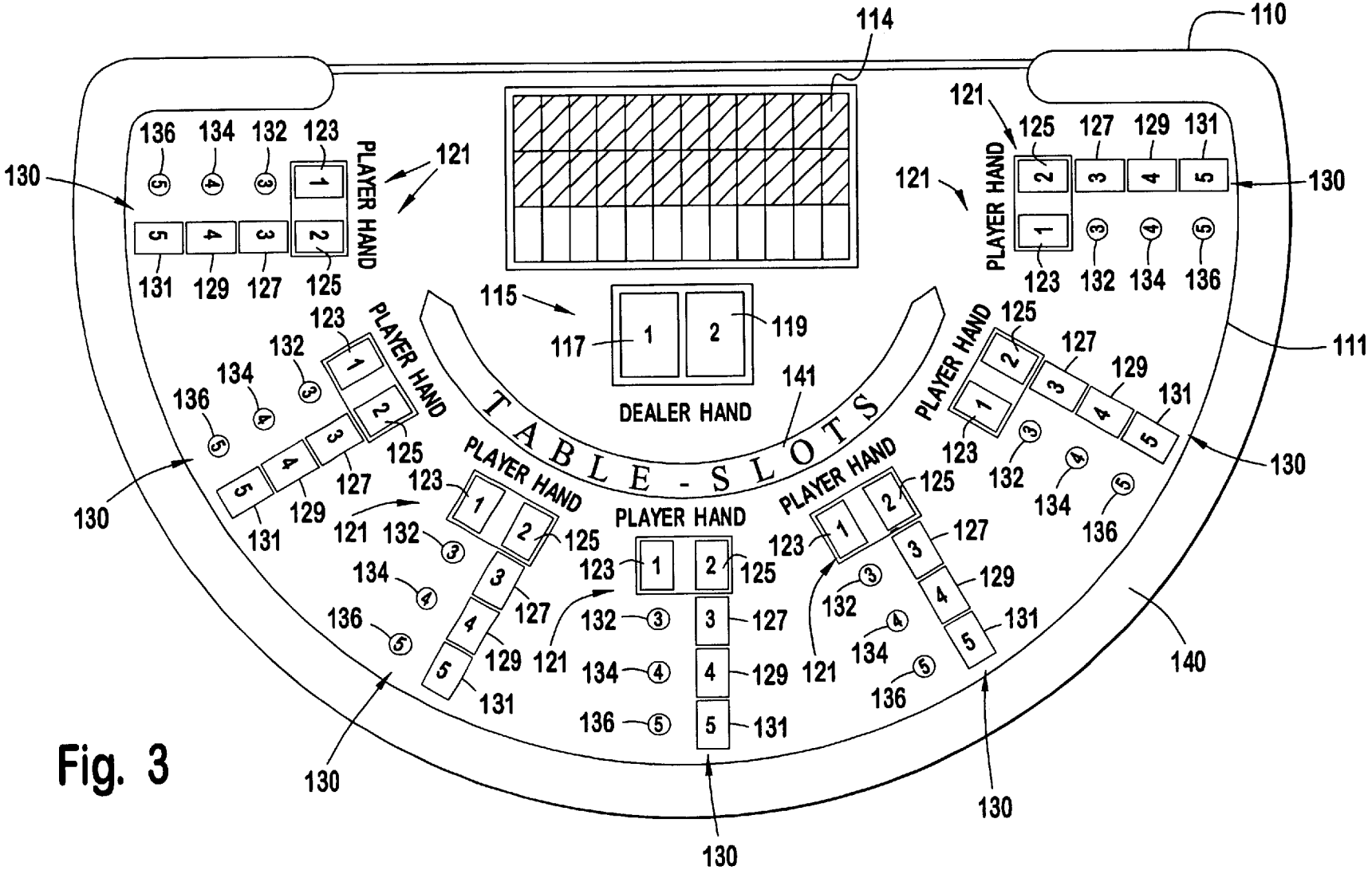
FIG. 3 is a plan view of a gaming table for playing a Table-Slots® game in accordance with a third embodiment of the present invention.

Referring now to FIG. 3, a plan view of the game table 110 for playing a Table-Slots® game in accordance with a third embodiment of the present invention is shown. The table 110 preferably has a generally semi-circular top 111 having a covering 112 that is preferably made from felt, but may be made from any other suitable material. The top 111 of the table 110 is of a standard size for a casino table game, and the covering 112 is removable such that it may be placed onto an existing tabletop 110 used in connection with other casino table games, such as blackjack.

The covering 112 includes provisions for a chip rack 114. Indicia used in connection with playing the game, which are described in more detail below, are printed on the covering 112. The chip rack 114 is located adjacent to the dealer area. The dealer area also includes a dealer hand 115 having card-receiving boxes 117 and 119. The card-receiving boxes include the indicia "1" and "2", respectively. The boxes 117 and 119 are preferably printed or silk-screened onto the covering 112. However, it will be recognized by those skilled in the art from the present disclosure that the boxes 117, 119 can be produced by other suitable means, such as adhering another layer of material to the covering 112 in a similar manner to the first preferred embodiment as described above.

Preferably, seven (7) player positions 130 are also provided. However, the number of player positions can be varied, if desired. The player positions 130 are located around the semi-circular portion of the table 110. Each player position 130 includes indicia on the covering 112 for building the player hand 121. The player hand 121 is defined by five (5) card-receiving boxes 123, 125, 127, 129 and 131 which include the printed indicia "1", "2", "3", "4" and "5", respectively. The card-receiving boxes 117, 119, 123, 125, 127, 129 and 131 are preferably sized such that a playing card can be placed within the box. It will be recognized by those skilled in the art from the present disclosure that the particular form, shape and location of the boxes 117, 119, 123, 125, 127, 129 and 131 on the covering 112 may be varied, as desired.

Preferably, each player position 130 also includes first, second and third wagering or ante receiving areas 132, 134 and 136. These are preferably in the form of printed indicia, preferably in the form of circles, located on the covering 112. The first wagering area 132 for receiving a player's first ante is located in proximity to the box 127. The first ante area 132 also includes the indicia "3". The second wagering area 134 for receiving a player's second ante is preferably located in proximity to the card-receiving box 129 and also includes the indicia "4". The third wagering area 136 for receiving the player's third ante is preferably located in proximity to the card-receiving box 131 and also includes the indicia "5" printed therein. It will be recognized by those skilled in the art from the present disclosure that the number of player ante receiving areas may be varied, if desired, depending upon the number of wagers which are to be made available for a given deal or play.

A cushioned rail 140 is preferably provided about the periphery of the table in the known manner. Printed indicia 141 identifying the game, the casino name or any other desired markings may also be added to the covering 112 in a location that does not interfere with the game layout.

In connection with the Table-Slots® game as shown in FIG. 3, preferably a fifty-two (52) card deck as previously described is utilized. Preferably, the five (5) casino logo cards are replaced with five (5) triple bar cards. However, the remaining cards remain the same. It will be recognized by those skilled in the art that the number and type of cards can be varied, as desired, and casino logo cards could be used.

In order to play a Table-Slots® game in accordance with the third embodiment of the invention, a deck of Table-Slots® cards is shuffled by hand by the dealer and/or placed into an automatic shuffling machine. A second deck may also be shuffled in a similar manner, if desired. Each player then places a minimum ante or optionally a larger wager in one or more of the wagering areas 132, 134, 136. The dealer then deals a card from the shuffled deck into each of the first two card-receiving boxes 123, 125 for each player. The dealer also deals two cards into the two-card receiving boxes 117, 119 to create a dealer hand 115. The dealer also deals three additional cards to each player which the player examines and places in a player determined sequence in the third, fourth and fifth card receiving boxes 127, 129 and 131. At least one (1) of the dealer cards in the dealer hand 115 is dealt face up. Preferably, this is the card in the second box 119. The remaining cards are preferably all dealt face down. However, it is possible that one or more of the cards in the player hand, such as the cards to be placed into the third, fourth and fifth boxes 127, 129 and 131 can be dealt face up. Alternatively, cards can be dealt directly into the third, fourth and fifth card receiving boxes 127, 129 and 131, either face-up or face-down, such that the sequence of the cards in the third, fourth and fifth boxes 127, 129, 131 is fixed.

After examining the third, fourth and fifth cards which the player places in the third, fourth and fifth card-receiving boxes 127, 129 and 131, the player may elect to play the unexamined first and second cards in the first and second card-receiving boxes 123 and 125 or may elect to play the cards in the dealer hand 115 in combination with the examined player cards located in the third, fourth and fifth card-receiving boxes 127, 129 and 131 to form the player hand 121. If a player chooses to use the cards dealt into the player hand 121, the dealer takes no action and moves to the next player. If a player chooses to use the dealer hand 115, the dealer then picks up the two cards in the first and second card-receiving boxes 123 and 125 of the player hand 121. These cards are preferably placed in the discard rack and not used for that round of play.

After all the players have decided which cards are to be used, if the player has chosen to play the cards in the first and second card-receiving boxes 123 and 125 of the player hand 121, these cards are then turned over. Alternatively, if a player has chosen to play the cards in the first and second boxes 117, 119 of the dealer hand 115, any face down cards in the dealer hand are turned over.

Next, the dealer determines if a three-card winning combination is present in the player hand, which may include the first, second and third player cards or the dealer hand and the third card of the player. If one of the three-card winning combinations is present, the player is paid off if he placed an ante in the ante-receiving area for the three-card winning combination. If one of the three-card winning combinations is not present, the dealer collects the ante from the wagering area 132.

The dealer then determines if a four-card winning combination is present in the player hand, which may include the first through fourth card-receiving boxes of the player or the dealer hand and the third and fourth card-receiving boxes for the player. If one of the four-card winning combinations is present, the dealer pays off the player if he placed an ante in the ante-receiving area for the four-card winning combination for the player. If one of the four-card winning combinations is not present, the dealer collects the ante from the wagering area 134.

The dealer then determines if a five-card winning combination is present in the player hand, which may include the first through fifth card-receiving boxes of the player or the dealer hand and the third, fourth and fifth card-receiving boxes for the player. If one of the five-card winning combinations is present, the dealer pays off the player if he placed an ante in the ante-receiving area for the five-card winning combination. If one of the five-card winning combinations is not present, the dealer collects the remaining ante on the gaming table for the player. The sequence for determining if each player has won on a three, four or five card combination can be varied, and is not critical to the present game. For example, the dealer can complete the examination and payout of a given player's entire hand before moving to the next player, or can advance sequentially to each player to examine and payout or collect on the three card hand, prior to proceeding with the four and five card hands.

The three-card winning combinations used in the third embodiment of the present invention along with the payoff for a one-unit wager, preferably of one dollar, are as follows:

| Winning Combinations Three Card Game | Payoff |
|---|---|
| C-*-* | Push |
| C-C-C | 3 |
| P-*-* | 1 |
| P-P-P | 5 |
| O-*-* | 1 |
| O-O-O | 7 |
| L-L-L | 10 |
| Bar-Bar-Bar | 15. |

The four-card winning combinations for the game in accordance with the third preferred embodiment of the present invention along with the pass for a one-unit wager are as follows:

| Winning Combinations Four Card Game | Payoff |
|---|---|
| C-C-C-C | 5 |
| P-P-P-P | 10 |
| O-O-O-O | 15 |
| L-L-L-L | 20 |
| Bar-Bar-Bar-Bar | 25. |

The five-card winning combinations for the game in accordance with third embodiment of the present invention as well as the payoffs for a one-unit wager as follows:

| Winning Combinations Five Card Game | Payoff |
|---|---|
| *-*-*-*-Bar | 1 |
| C-C-C-C-C | 25 |
| P-P-P-P-P | 50 |
| O-O-O-O-O | 75 |
| L-L-L-L-L | 100 |
| Bar-Bar-Bar-Bar-Bar | 50,000. |

Those skilled in the art will recognize that the payoffs and winning combinations can be varied, as desired. Additionally, other currencies can be used and more than one unit can be wagered up to any maximum set by the house.

It will be recognized by those skilled in the art from the present disclosure that the use of a shuffling machine, the number of card decks and the particular shuffling employed can be varied, as desired. Additionally, less frequent shuffling can be provided by using multiple decks such that the dealer could deal several games prior to reshuffling.

It will be similarly recognized by those skilled in the art from the present disclosure that the number of cards used in each game can be varied. For example, more or less than five card receiving boxes 16, 18, 20, 22, 24 may be provided. While the payout tables provided above are preferred, it will be recognized by those skilled in the art from the present disclosure that other payout tables may be used, if desired.

The present game provides the excitement of slot machine play in a table gaming environment. It also provides the opportunity to make several wagers for a single deal in order to increase the number of wagers or gaming decisions which are made per unit time. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A method of playing a card game comprising:

(a) providing a deck of cards having at least five different symbols thereon and a gaming table with a plurality of player positions, the gaming table including five card receiving boxes for each player position and two card receiving boxes for a dealer position which are adapted to receive cards dealt from the deck, and each player position including three ante receiving areas;

(b) shuffling the deck of cards by the dealer;

(c) placing an ante in at least one ante receiving area by a player at at least one of the plurality of the player positions;

(d) the dealer dealing one card from the shuffled deck into each of the first two card receiving boxes for each of the ante placing players;

(e) the dealer dealing three additional cards to each of the ante placing players;

(f) the dealer dealing a card into each of the two card receiving boxes for the dealer to create a dealer hand, at least one of the cards in the dealer hand being dealt face up;

(g) each of the ante placing players examining the three additional cards dealt to the player and placing the three additional cards in the third, fourth and fifth card receiving boxes;

(h) each of the ante placing players electing to play the unexamined first and second cards in the first and second player card receiving boxes or the dealer hand in combination with the examined player cards to form a player hand;

(i) determining if a three-card winning combination is present in the player hand for each of the ante placing players;

(j) if one of the three-card winning combinations is present, paying off the player who placed the ante in the ante receiving area for the three-card winning combination;

(k) determining if a four-card winning combination is present in the player hand for each of the ante placing players;

(l) if one of the four-card winning combinations is present, paying off the player who placed the ante in the ante receiving area for the four-card winning combination;

(m) determining if a five-card winning combination is present in the player hand for each of the ante placing players; and (n) if one of the five-card winning combinations is present, paying off the player who placed the ante in the ante receiving area for the five-card winning combination, and if one of the five-card winning combinations is not present, the dealer collecting the ante remaining on the gaming table.

2. The method of claim 1, further comprising removing the cards in the first and second card receiving boxes if the player elects to use the dealer hand.

3. The method of claim 1 wherein the three-card winning combinations are as follows:

C-*-*

C-C-C

P-*-*

P-P-P

O-*-*

O-O-O

L-L-L

Bar-Bar-Bar, where * represents any symbol.

4. The method of claim 3 wherein payoffs for the three-card winning combinations for a one unit wager are as follows:

| Winning Combinations Three Card Game | Payoff |
|---|---|
| C-*-* | Push |
| C-C-C | 3 |
| P-*-* | 1 |
| P-P-P | 5 |
| O-*-* | 1 |
| O-O-O | 7 |
| L-L-L | 10 |
| Bar-Bar-Bar | 15. |

5. The method of claim 1 wherein the four-card winning combinations are as follows:

C-C-C-C

P-P-P-P

O-O-O-O

L-L-L-L

Bar-Bar-Bar-Bar.

6. The method of claim 5 wherein payoffs for the four-card winning combinations for a one unit wager are as follows:

| Winning Combinations Four Card Game | Payoff |
|---|---|
| C-C-C-C | 5 |
| P-P-P-P | 10 |
| O-O-O-O | 15 |
| L-L-L-L | 20 |
| Bar-Bar-Bar-Bar | 25. |

7. The method of claim 1 wherein the five-card winning combinations are as follows:

Winning Combinations
Five Card Game
*-*-*-*-Bar
C-C-C-C-C
P-P-P-P-P
O-O-O-O-O

L-L-L-L-L
Bar-Bar-Bar-Bar-Bar.

8. The method of claim 7 wherein payoffs for the five-card winning combinations for a one unit wager are as follows:

| Winning Combinations Five Card Game | Payoff |
|---|---|
| *-*-*-*-Bar | 1 |
| C-C-C-C-C | 25 |
| P-P-P-P-P | 50 |
| O-O-O-O-O | 75 |

-continued

| Winning Combinations Five Card Game | Payoff |
|---|---|
| L-L-L-L-L | 100 |
| Bar-Bar-Bar-Bar-Bar | 50,000. |

9. The method of claim 1 wherein the three additional cards dealt to each of the players are placed in the third, fourth and fifth card receiving boxes in a player determined sequence.

* * * * *